US008439766B1

(12) United States Patent
Brown

(10) Patent No.: US 8,439,766 B1
(45) Date of Patent: May 14, 2013

(54) SYSTEM AND METHOD FOR ENHANCING GOLF

(76) Inventor: Lincoln Tyler George Brown, Lexington, KY (US)

( * ) Notice: Subject to any disclaimer, the term of this patent is extended or adjusted under 35 U.S.C. 154(b) by 0 days.

(21) Appl. No.: 13/020,834

(22) Filed: Feb. 4, 2011

Related U.S. Application Data

(60) Provisional application No. 61/301,324, filed on Feb. 4, 2010.

(51) Int. Cl.
*A63F 9/24* (2006.01)

(52) U.S. Cl.
USPC ..... 473/131; 463/42

(58) Field of Classification Search ..... 473/131
See application file for complete search history.

(56) References Cited

U.S. PATENT DOCUMENTS 5,102,140 A 4/1992 Vincent
5,884,913 A * 3/1999 Cohen ..... 473/154
2002/0188360 A1* 12/2002 Muramori et al. ..... 700/91
2011/0067621 A1* 3/2011 Jakobsson ..... 116/173

* cited by examiner

*Primary Examiner* — Omkar Deodhar
(74) *Attorney, Agent, or Firm* — King & Schickli, PLLC

(57) ABSTRACT

A system and method for monitoring and verifying one or more shot events, such as the outcome of the shot, at a selected golf hole located at a golf course. In one particularly preferred embodiment, the invention allows for the awarding of a prize to any player that either hits or comes close to hitting a hole-in-one on a qualifying hole at any time the golf course is open and witnessed, without the need for the player to make any commitment to enter any contest or pre-register before taking the golf shot in order to be eligible. Declared winners may be entitled to claim different types of prizes that have been previously established depending on the level of sponsorship or the difficulty of a specific hole. The prizes need not be offset by insurance, as is typical, but instead are funded by advertisers as paid sponsors of the particular hole. Accordingly, the cost to the owner of the golf course may be borne entirely by advertising (such as signs positioned adjacent the green of the particular hole to which the contest applies) and may further represent an added source of revenue.

20 Claims, 6 Drawing Sheets

SYSTEM AND METHOD FOR ENHANCING GOLF

This application claims the benefit of U.S. Provisional Patent Application Ser. No. 61/301,324, filed Feb. 4, 2010 the disclosure of which is incorporated herein by this reference.

FIELD OF THE INVENTION

This disclosure relates to golf and, in particular, to a system and method for enhancing the sport of golf.

BACKGROUND OF THE INVENTION

Although difficult to assess, the probability of a hole-in-one shot is very low, and is often estimated at 1 in 12,500 shots (0.008%). Commonly, a prize is offered during golf tournaments, known as scrambles, to a golfer that achieves a hole-in-one. These tournaments are special circumstances and not where the majority of hole-in-ones take place, as the vast majority of hole-in-ones happen during normal play. These shots are often not witnessed by anyone that is not in that particular golfer's party. In most cases there are no hole-in-one prizes offered because (1) no one is monitoring the play, as would occur in a scramble; and (2) it is not part of a tournament or special occasion where the sponsors provide a reward for hitting a hole-in-one.

Others in the past have provided systems and methods for monitoring the occurrence of a hole-in-one. One example is found in U.S. Pat. No. 5,102,140, incorporated herein by reference, which describes a system in which a user can engage a coin-operated machine prior to taking their golf shot in order to win a prize in the event of a hole-in-one. The downside is that such events are so rare and the chances of winning so low, players are unlikely to make the commitment to pay the fee before the fact. Concomitantly, the prize will remain low and further discourage participation in the program.

Accordingly, a need is identified for systems and methods that strike the correct balance between the risk to the golf course of providing a reward for a particular shot, such as a hole-in-one, and the reward to the golfer for participating in a contest offering such rewards.

SUMMARY OF THE INVENTION

In one aspect, this invention relates to a system and method for monitoring and verifying one or more shot events, such as the outcome of the shot, at a selected golf hole located at a golf course. In one particularly preferred embodiment, the invention allows for the awarding of a prize to any player that either hits or comes close to hitting a hole-in-one on a qualifying hole at any time the golf course is open and witnessed, without the need for the player to make any commitment to enter any contest or pre-register before taking the golf shot in order to be eligible. Declared winners may be entitled to claim different types of prizes that have been previously established depending on the level of sponsorship or the difficulty of a specific hole. The prizes need not be offset by insurance, as is typical, but instead are funded by advertisers as paid sponsors of the particular hole. Accordingly, the cost to the owner of the golf course may be borne entirely by advertising (such as signs positioned adjacent the green of the particular hole to which the contest applies) and may further represent an added source of revenue.

BRIEF DESCRIPTION OF THE DRAWING FIGURES

DETAILED DESCRIPTION OF A PREFERRED EMBODIMENT

Reference is now made to FIGS. 1-6, which schematically illustrate a golf hole H on a golf course to which the method and system 10 of the invention may be applied. Use of the system and method is intended for a typical golf hole H, including a cup C on a green G that can be reached in only one shot from the tee T and over a fairway Y, and also having clear line of sight between the tee T and the cup C. These holes are typically referred to as "Par 3s," and have a distance D from the tee T to the cup C that is less than about 250 yards. However, use of the disclosed system 10 and method is not necessarily limited to any particular type of golf hole H, and may thus have application in other arrangements.

Figure 1:
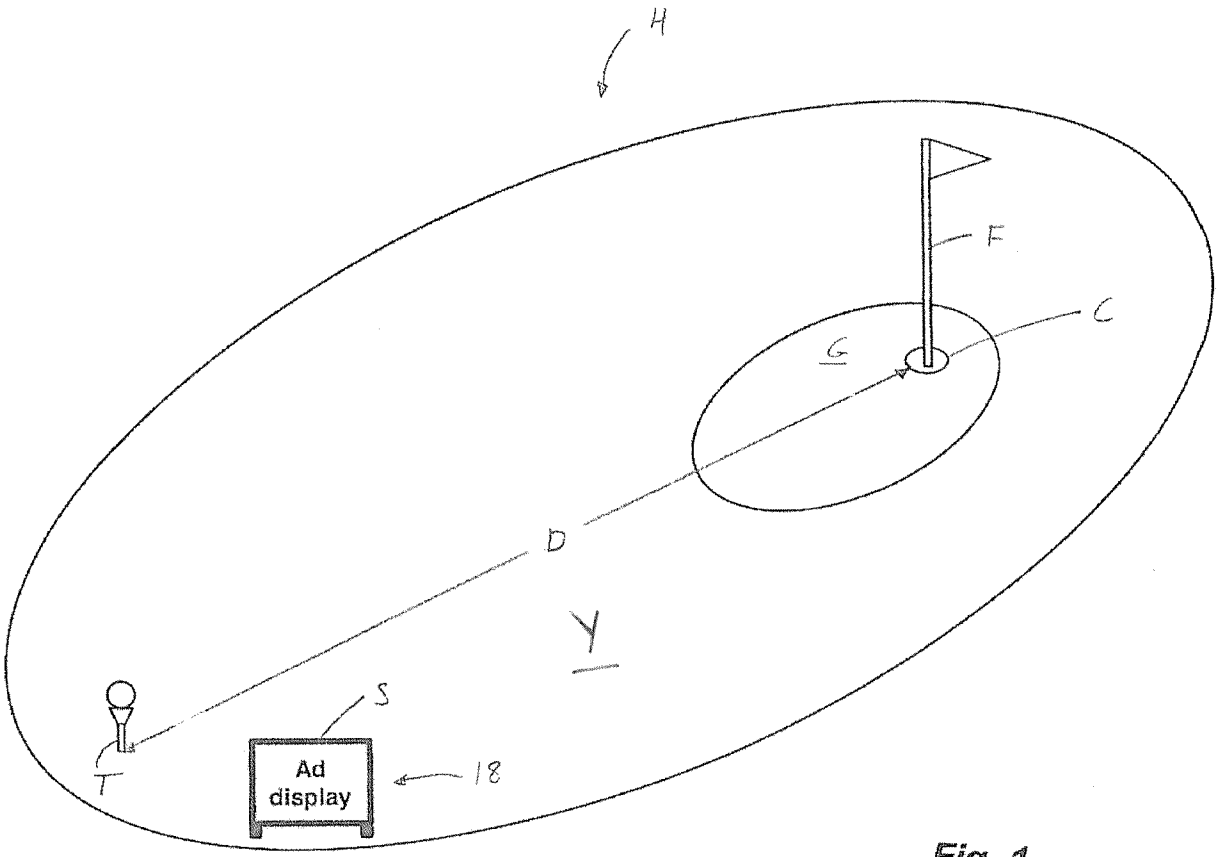
FIG. 1 is a schematic illustration of an environment of use of one or more of the disclosed inventions, including a tee and golf hole.
Figure 2:
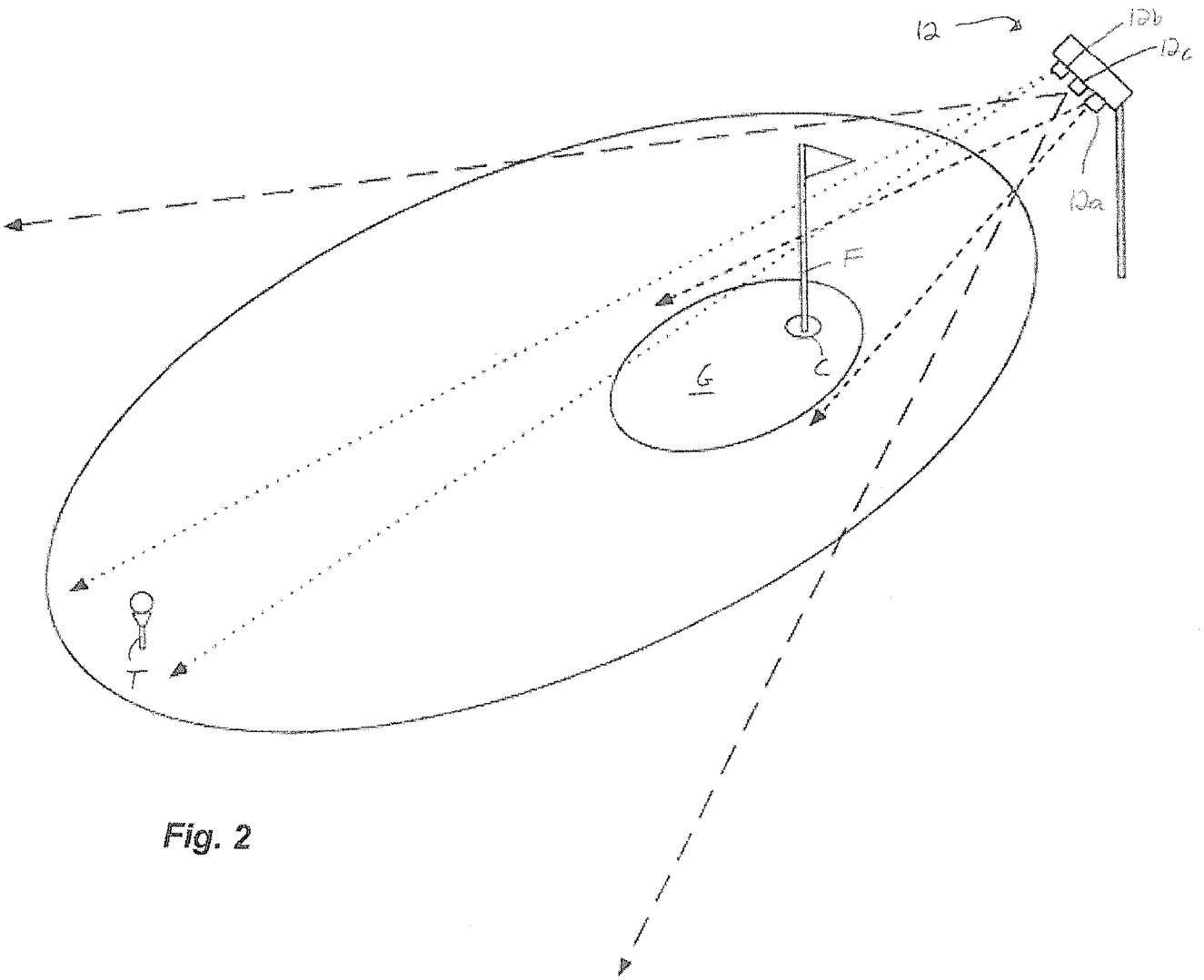
FIG. 2 is a schematic illustration similar to FIG. 1, including a camera.

One aspect of the system 10 is the ability to monitor a single golf shot taken by a golfer at the involved hole. Referring now to FIG. 2, this monitoring may be achieved using an imaging device or image recorder, such as at least one camera 12, associated with the hole H and adapted for recording the golf shot. In the case of a camera 12, it is preferably fixedly located at a strategic location adjacent the hole H with a view of the cup C. Most preferably, as shown in FIG. 2, this camera 12 is capable of automatically recording, transmitting, and/or storing streaming video from different angles relative to the tee T and cup C to allow for a confident assertion that a particular shot once made meets a pre-determined criteria necessary to allow the golfer to claim a prize (e.g., closest to the pin, a hole-in-one, etc.).

Figure 3:
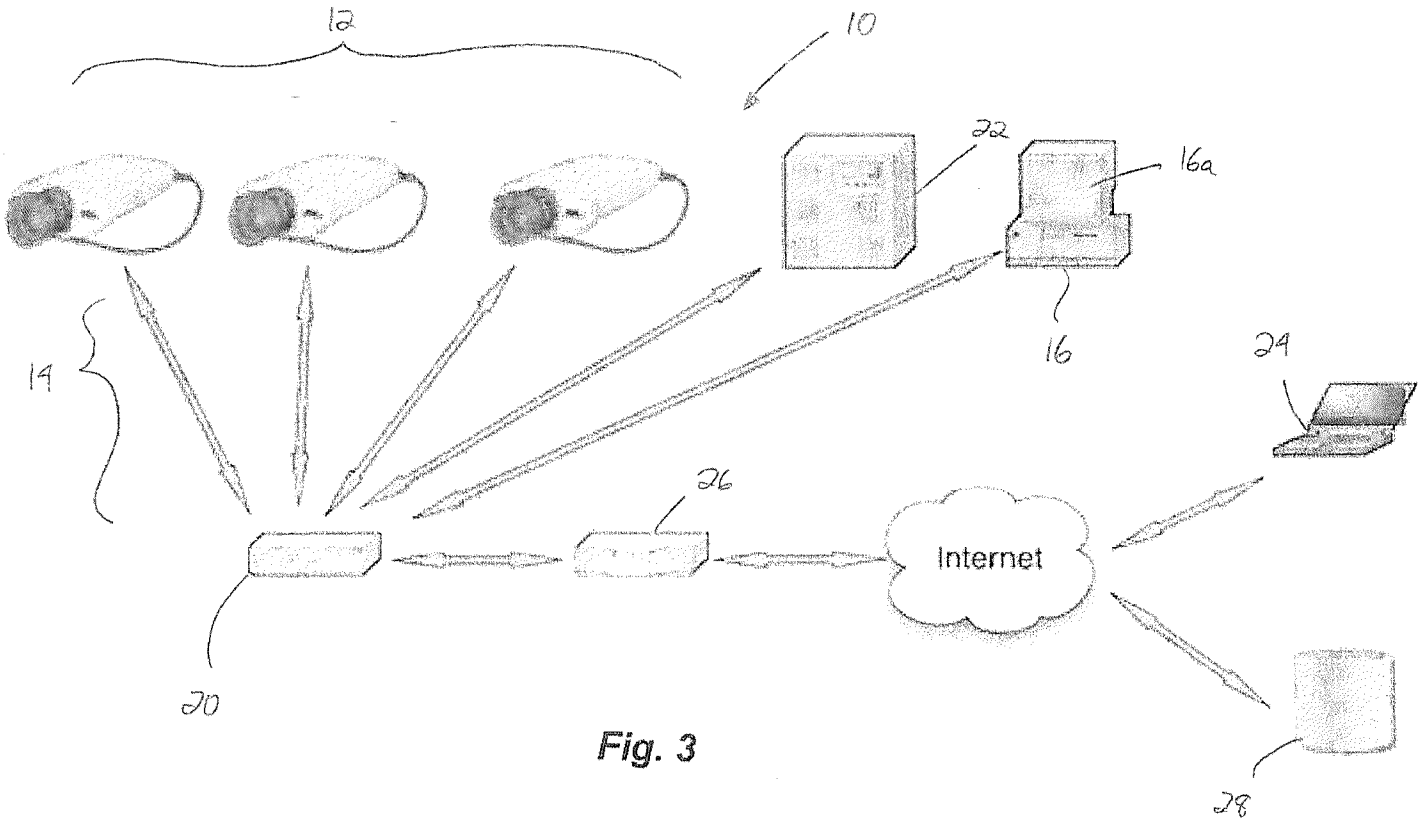
FIG. 3 is a schematic illustration illustrating one manner of recording an image associated with a golf shot and transmitting the image over a network.

The images recorded by the recording device, such as camera 12, may be used to verify the occurrence of the particular shot event (e.g., outcome) at issue, such as a hole-in-one resulting from the player's tee shot. This may be done by transmitting one or more visual representations over a computer network 14 to a remote server 16, as shown in FIG. 3. This server 16 may comprise a central computer terminal located elsewhere on the golf course (such as at a clubhouse, pro shop, or office). Preferably, the remote server would be adapted to allow the video images from the camera 12 to be displayed to a person at that location, such as by using a display 16*a*.

The network 14 may comprise a local area network, or LAN. This network 14 may be interconnected with the camera 12 and the server 16 either via wires or wirelessly utilizing an appropriate communication standard (e.g., IEEE 802.11 or the like). At the server location, a network switch 20 interconnects the recording device, such as cameras 12, associated with a hole H or the entire course to a storage device 22 for storing captured content corresponding to shots for a given period of time (e.g., the past week), the shots for several holes, or both.

When a particular event is verified to meet the pre-determined criteria, such as a hole-in-one, the player may be eligible for a pre-defined prize. In accordance with one aspect of this disclosure, the prize is provided or sponsored by third-party advertisers (that is, advertisers other than the golf course itself) who pay to have advertisements placed around the golf course. The advertisements may be adjacent the fairway Y or the green G, but most preferably are provided at the tee location for the hole H. Thus, in the example shown in FIG. 1, the advertiser may pay to have a display 18 placed adjacent the golf hole H (e.g., at the tee T), including an advertisement linking the advertiser with the particular prize awarded for the designated outcome. Contracting for ad placement may be done by the golf course management, or instead by a service provider that receives a portion of the advertising revenue in exchange for its services.

Given that the prizes or awards are funded by advertising dollars or sponsored by the advertisers, no separate charges or entry fee are necessary to contend for the prize by making the golf shot. For this reason, the financial commitment by the golf course for utilizing the system and method may be minimal to none, in the event a service provider provides the system 10 and arranges for the placement of the sponsored advertisements in exchange for a portion of the advertising revenue. For the golfer, paying the course's standard fees for course access may be the only monetary requirement to participate. This lack of the requirement for a subscription before hitting the shot encourages participation in an effort to win prizes from golfing without making any financial commitment that would not otherwise be necessary, and thus enhances the enjoyment and competitiveness of the sport of golf.

To track participation and help to confirm the occurrence of shot events by particular individuals, it may be desirable to require players to meet certain eligibility requirements, such as by providing certain contact information beforehand. Then, when the golfer alerts the course official that they might have qualified for a prize, such as in person or by way of an electronic communication, the contentions made by the participant may be verified. The verification process may occur by reviewing any recorded images from different angles, as well as to confirm that the player did in fact make the shot, and did not take multiple shots or otherwise engage in untoward or unethical behavior (the definition of which may be established by rules provided before the round of golf). If and when confirmation of a qualifying event is made, such as a hole-in-one, the player will be provided with the prize, but again without any subscription prior to making the golf shot.

Figure 4:
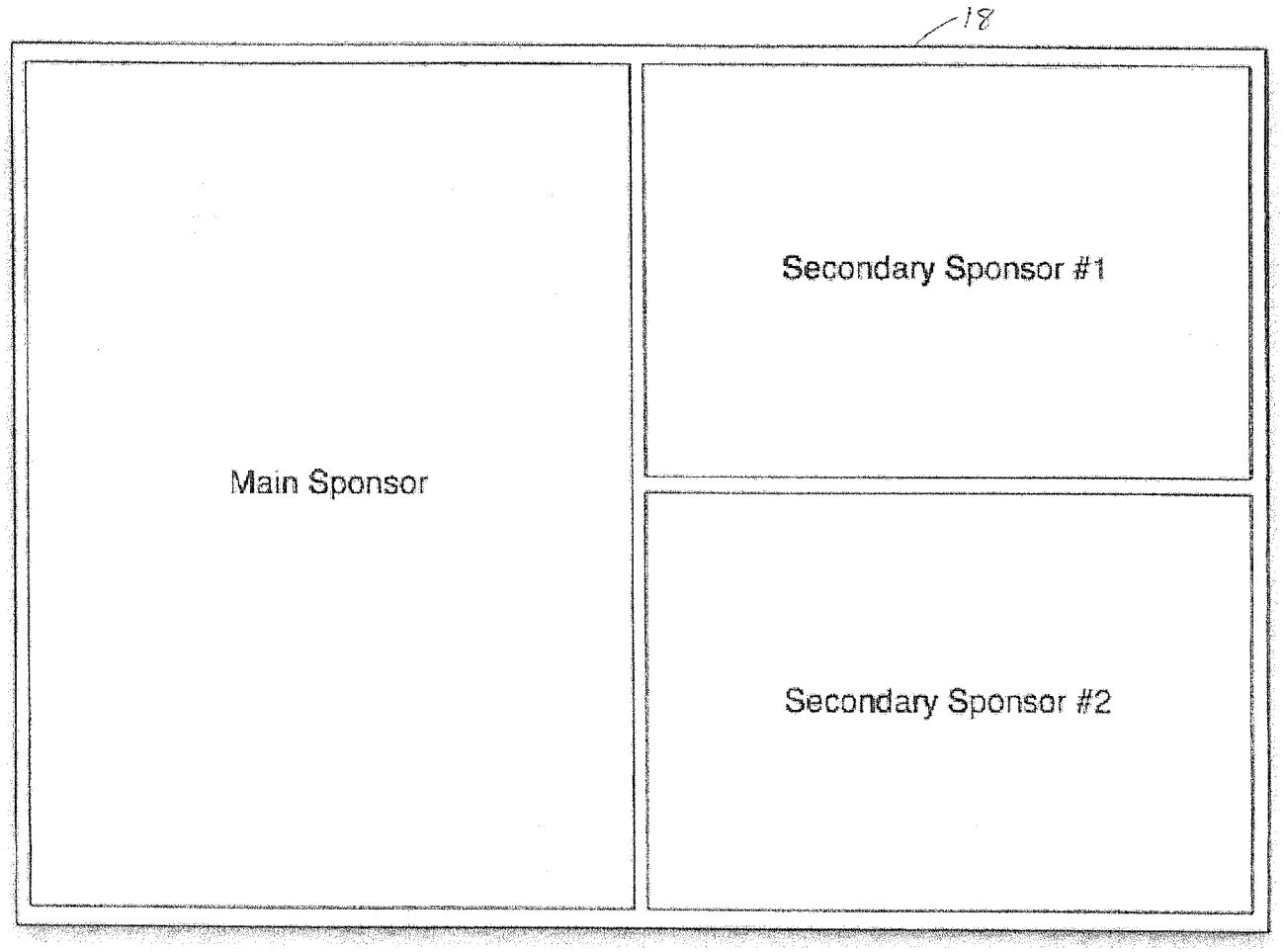
FIG. 4 is a schematic diagram showing an example of an advertisement.

In terms of offering the prize through advertising, the one or more sponsors may be provided with the use of a customizable display 18 per hole, such as on a sign S. One example of such a display 18 is a double-faced, weatherproof frame and designed to fit removable printed inserts, making it simple to change or rotate the advertisers among different holes or at different times (and thus potentially change the prizes awarded to maximize interest). The display 18 may accommodate one or more ads, depending on the level of sponsorship. Thus, as shown in FIG. 4, the display 18 may be arranged such that a main sponsor covers a majority of the display area and the remainder is divided between two (or more) secondary sponsors (e.g., one for a car awarded for a hole in one, and the other for golf-related awards (such as a new club, gift certificate, etc.) for being closest to the pin or for the longest putt). Alternatively, the display 18 may also comprise a portion of the score card (not shown) or the flag F associated with the hole H, either of which may be reserved for the primary sponsor.

As suggested above, the prize to be awarded may vary depending on the event. For example, a large prize may be provided for a hole-in-one, with one or more lesser prizes for the shot meeting a different pre-determined criteria (e.g., being within a certain radius of the cup C, which may be determined using the recorded video images from the one or more cameras 12). Furthermore, in the case where there are multiple advertisers associated with a particular hole H, each may sponsor a different one of the prizes, which may be related to the player through the display 18. The prizes may include cash, services (e.g., a massage, vacation, etc.), tangible items associated with the advertisers (e.g., an automobile, golf clubs), coupons or certificates to receive such goods or services, discounts on such, or any combinations thereof.

To ensure accurate recording of the events associated with a golf shot or portion thereof, several different manners of arranging the system 10 are envisioned. In one, the recording device comprises three cameras 12*a*, 12*b*, 12*c* placed behind the cup C at a particular height, as shown in FIG. 2. Each of the cameras 12*a*, 12*b*, 12*c* is arranged at a different angle relative to the cup C to establish a unique point of view of the play. For instance, one camera 12*a* may point down to the hole providing the system user certainty that the shot hit the hole. Another camera 12*b* may be directed to the tee T where the player is located prior to and during the golf shot. This camera 12*b* may be provided with a lens that allows close view with the player body (for identification purposes) and the tee completely framed. The third camera 12*c* may be provided with a wide angle lens that allows the capture of digital video that includes both the player at the tee T and the cup C.

Figure 5:
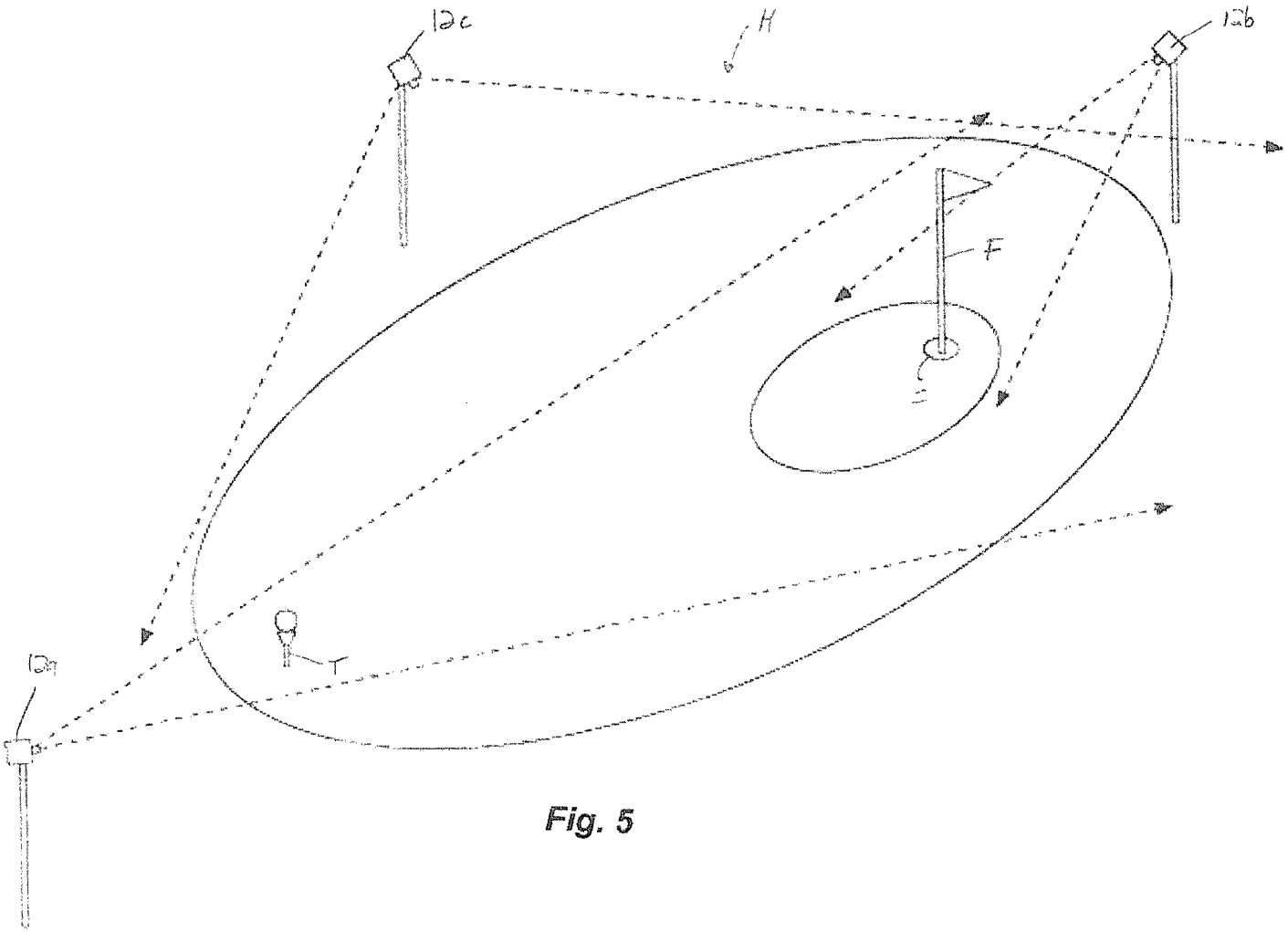
FIG. 5 is a schematic illustration similar to FIG. 1, including a plurality of cameras.

Alternatively, with reference to FIG. 5, the three cameras may be arranged such that one camera 12*a* is placed behind the tee T framing the player as he or she makes the shot. A second camera 12*b* is placed behind the cup C, opposite to a camera 12*c* framing the cup C and flag F. The third camera 12*c* is placed on one side of the hole with a wide angle lens permitting to position both tee T (and player) and cup C (with flag F) inside the video frame.

Figure 6:
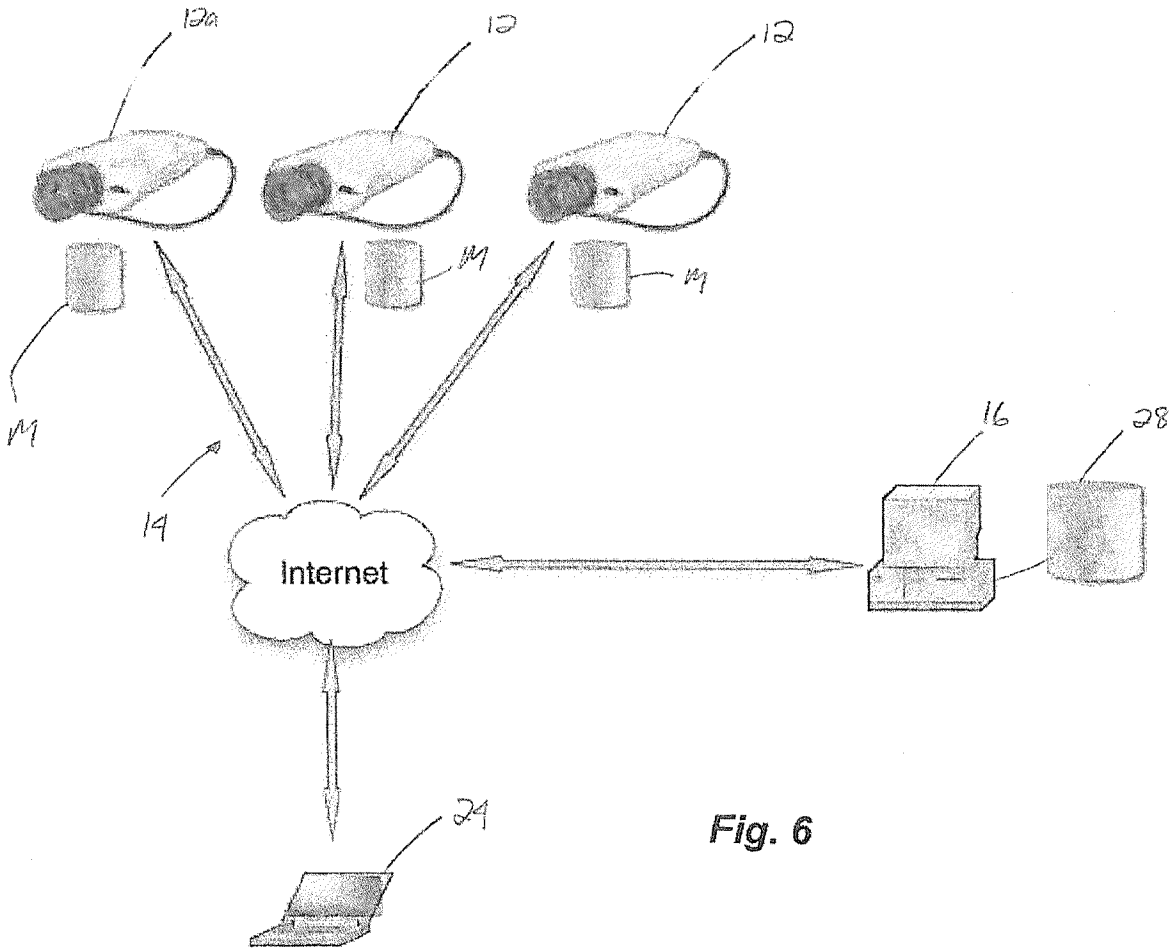
FIG. 6 is a schematic illustration illustrating another manner of recording an image associated with a golf shot and transmitting the image over a network.

Turning to FIG. 6, a possible network architecture would not utilize a local server to receive the image data for initial storage, but instead rely on individual storage capacity for each recording device, such as cameras 12*a*, 12*b*, 12*c*. Each camera 12*a*, 12*b*, 12*c* would have a memory M, which may comprise a removable non-volatile memory card commonly used in personal digital cameras, mobile phones, and the like. A modem may be connected to the cameras 12*a*, 12*b*, 12*c* to allow for remote access to the stored video content over the network 14, which may be connected to the Internet.

In any case, it is also an option to use sensors to allow only action scenes to be recorded. For example, a motion sensor may be provided, most preferably at or near the tee T, to start the recording device to record the shot upon detecting movement at a particular location or within a particular range. Alternatively, the golfer may manually initiate the recording event from adjacent to the tee T, or it may be initiated from a remote location, such as the clubhouse, based on the observation that a shot is about to be taken (from the tee T or otherwise).

The cameras used would preferably have the ability to capture a continuous stream of video using different compression formats (e.g., Motion JPEG (M-JPEG) or H-264). The M-JPEG format stores every frame of a video sequence independently. H-264 uses interframe compression to reduce the data stored by comparing frames with a key frame and only the regions that have changed are stored. With the H-264 format, the system 10 can achieve up to 80% reduction on storage requirements without losing important visual information from the golf shot. Different cameras in the setup around the hole H can also record with different formats or frames per second rates to achieve maximum network bandwidth efficiency preserving the quality necessary for verification of shots. An exemplary camera arrangement comprises MOBOTIX Network IP megapixel cameras (XM12D-SEC D43D135) using a cellular uplink modern, all of which may be solar powered.

Although use of the system 10 and method in connection with a hole-in-one event or otherwise with shots directed at the hole H is envisioned, other uses are also possible. For example, the system 10 and method may be used to sponsor a particular type of golf shot, including but not limited to the longest shot or closest shot to the cup C for a given hole H, whether made from the tee T or not, the longest putt made, or any other shot outcome once the gold ball is struck by the participating golfer.

With reference to FIGS. 3 and 6, it is also an option to allow for the images obtained of the qualifying shot to be accessed via the network 14 from a remote location, such as a remote client 24, connected via the Internet to a network router 26. Thus, for example, the golfer may be able to access the images of his or her shot over the Internet later to entertain family and friends. The associated images when displayed over the Internet at a web site may also be sponsored by advertisers as an added source of potential revenue, thus furthering the revenue and exposure as the result of the event. Alternatively, it is possible to sell recorded images of the shot, such as on a portable medium (e.g., a disc), for later playback by the purchaser on a home device, such as a DVD player. The Internet may also be used for remote or offsite storage 28 of the image data.

The foregoing descriptions of various embodiments of the invention are provided for purposes of illustration, and are not intended to be exhaustive or limiting. Modifications or variations are also possible in light of the above teachings. The embodiments described above were chosen to provide the best application to thereby enable one of ordinary skill in the art to utilize the disclosed inventions in various embodiments and with various modifications as are suited to the particular use contemplated. All such modifications and variations are within the scope of the invention.

The invention claimed is:

1. A method for enhancing participation in golf, comprising:

advertising a prize to a golfer in exchange for completing a golf shot at a golf hole according to one or more pre-determined criteria without requiring the golfer to subscribe before taking the golf shot; and obtaining an image of at least a portion of the golf shot; and using the image to determine whether the one or more pre-determined criteria is met.

2. The method of claim 1, wherein the step of obtaining the image comprises using a camera to obtain the image including an outcome of the shot.

3. The method of claim 2, wherein the obtaining step comprises using a camera fixedly positioned at the golf hole and linked to a network.

4. The method of claim 3, further including the step of transmitting one or more images representing at least the portion of the shot over the network.

5. The method of claim 4, wherein the transmitting over the network comprises transmitting data on the Internet.

6. The method of claim 4, wherein the transmitting over the network comprises transmitting data on a local area network linked to a server.

7. The method of claim 4, wherein the transmitting over the network is done wirelessly.

8. The method of claim 1, wherein the advertising comprises providing an advertisement at the golf hole identifying at least one sponsor of the prize, and wherein the sponsor provides the prize.

9. The method of claim 8, further including the step of providing the advertisement at a location selected from the group consisting of a sign placed at a tee, a fairway, or adjacent the golf hole, on a scorecard, and on a flag supported by a stick adapted for being received within with the golf hole.

10. The method of claim 8, further including the step of providing a plurality of different prizes, each corresponding to a different advertisement.

11. A method for enhancing participation in golf, comprising:

advertising at a golf course the availability of a prize to a golfer hitting a shot having a pre-determined outcome without requiring the golfer to subscribe before hitting the shot in exchange for an advertising fee from at least one sponsor; and viewing at a remote location an image of at least a portion of the shot and determining whether the prize should be awarded.

12. The method of claim 11, further including the step of performing the advertising step by providing one or more advertisements identifying one or the sponsor or the prize at a golf hole associated with the shot.

13. The method of claim 11, wherein the step of advertising the availability of the prize to the golfer comprises advertising in exchange for a plurality of advertising fees from different entities.

14. The method of claim 11, further including the step of providing a plurality of prizes supplied by a plurality of different sponsors.

15. A system for enhancing participation in golf at a golf course including a hole for being played by a golfer capable of hitting a golf shot, comprising:

at least one imaging device at the golf hole for obtaining one or more images of at least a portion of the golf shot;

at least one prize for awarding to the golfer based on a determination from viewing the image that at least one aspect of the shot corresponds to a pre-determined event; and a sponsored, third-party advertisement associated with the golf hole corresponding to the at least one prize, wherein the golfer is not required to subscribe before hitting the golf shot.

16. The system of claim 15, wherein a payment is made for the sponsored, third-party advertisement, said payment being used to at least partially fund the at least one prize.

17. The system of claim 15, further including a medium for storing the one or more images.

18. The system of claim 15, further including a plurality of prizes, each corresponding to a different pre-determined event at the hole.

19. The system of claim 15, wherein the advertisement is provided at a location selected from the group consisting of a sign placed at a tee, a fairway, or adjacent the golf hole, on a scorecard, and on a flag supported by a stick adapted for being received within with the golf hole.

20. The system of claim 15, further including a network for transmitting the one or more images to a remote location.

* * * * *